US005748091A

United States Patent [19]

Kim

[11] Patent Number: 5,748,091

[45] Date of Patent: May 5, 1998

[54] FIBER OPTIC ICE DETECTOR

[75] Inventor: John Jungwoo Kim, Riverside, Calif.

[73] Assignee: McDonnell Douglas Corporation, Huntington Beach, Calif.

[21] Appl. No.: 726,102

[22] Filed: Oct. 4, 1996

[51] Int. Cl.[6] ..... G08B 19/02

[52] U.S. Cl. ..... 340/583; 340/962; 340/580; 356/381; 356/382; 73/170.26; 244/134 F

[58] Field of Search ..... 340/583, 962, 340/580; 356/381, 382; 73/170.26; 244/134 F

[56] References Cited

U.S. PATENT DOCUMENTS

| | | | |
|---|---|---|---|
| 2,359,787 | 10/1944 | Peters et al. | 250/201 |
| 3,045,223 | 7/1962 | Kapany et al. | 340/234 |
| 3,540,025 | 11/1970 | Levin | 340/234 |
| 3,792,928 | 2/1974 | Poilleux | 356/4 |
| 3,807,870 | 4/1974 | Kalman | 356/161 |
| 4,327,286 | 4/1982 | Thoma | 250/231 |
| 4,782,331 | 11/1988 | Martens | 340/583 |
| 4,797,660 | 1/1989 | Rein, Jr. | 340/583 |
| 4,803,470 | 2/1989 | Fineman | 340/583 |
| 4,851,817 | 7/1989 | Brossia | 340/583 |
| 5,005,005 | 4/1991 | Brossia | 340/604 |
| 5,014,042 | 5/1991 | Michoud | 340/583 |
| 5,180,122 | 1/1993 | Christian | 244/134 |
| 5,484,121 | 1/1996 | Padawer | 244/134 |
| 5,596,320 | 1/1997 | Barnes | 340/583 |

*Primary Examiner*—Thomas Mullen
*Assistant Examiner*—Sihong Huang
*Attorney, Agent, or Firm*—Bell Seltzer Intellectual Property Law Firm of Alston & Bird, LLP

[57] ABSTRACT

The thickness of a semi transparent layer, such as ice, is determined by supporting the layer atop or above a light transmissive window and directing multiple light beams through the light transmissive window and into the layer. The light transmissive window has a higher index of refraction than the layer or any intermediate layer directly above the semi-transparent layer. Light beams are directed at an angle to the surface that results in total internal reflection from the outer surface of the supported semi-transparent layer. The light reflected to the rear of the window at the same but opposite angle is monitored and correlates to the thickness of the monitored layer. The spatial distribution of reflected light along the longitudinal axis of the window changes in dependence upon the thickness of the supported layer. Quantitative indications of that thickness are displayed and should that thickness exceed a prescribed level an alarm may be generated. The monitoring system has application as a non-intrusive ice detection system for aircraft airfoil surfaces.

22 Claims, 2 Drawing Sheets

FIBER OPTIC ICE DETECTOR

FIELD OF THE INVENTION

This invention relates to a device for measuring and indicating the thickness profile of a semi-transparent layer, such as a thin film, and solid and liquid layers, and, more particularly, to an ice detector for monitoring any ice build up on an aircraft surface and alerting when such build up attains an excessive level.

BACKGROUND

Existing aircraft ice detectors are able to detect the presence of ice on the aircraft's wing, but not its thickness. Detectors used in present practice employ a protrusion type probe that extends into the airflow over the wing. Disadvantageously protrusion type probes produce some disturbance to the laminarity of the air flow across the wing's surface.

Although forms of probes that are non-protruding as part of optical type ice detection devices have been known as evidenced in the patent literature, they do not appear to have been placed into aircraft application for unknown reasons. As example U.S. Pat. No. 3,045,223 granted Jul. 17, 1992 to Kapany describes a device in which an optical light source and a sensor are connected respectively to two light pipes that each have a flat side surface and are placed adjacent one another. Uncovered, the light from the source is normally emitted from the flat surface into the air. However when a layer of ice is deposited over the flat surfaces, the light emitted from the one light pipe is refracted by the ice and reflected into the adjacent light pipe where the light is detected by the light sensor. Through accompanying electronic circuits, the detection of that light indicates the presence of ice. This is a "go" or "no go" type of monitoring approach.

The same "go" or "no go" approach with another optical device containing non-protruding flush mounted sensors, appears in a more recent patent U.S. Pat. No. 5,484,121, granted Jan. 16, 1996, to Padawer and Goldberg. The latter patent illustrates more modern components, such as the use optical fibers to conduct light as part of the light source and light detectors, and more sophisticated electronic processing and signaling equipment that conveys warnings to the pilot and, remotely, to the airport control tower. For increased reliability in sensing the ice at a given location on an aircraft surface, Padawer forms a circle of separate fiber optic cords each of which is coupled to the light sensor and places the fiber optic cord from the light source in the center of that circle, thereby ensuring that ice formed at that location is properly detected even if the ice is unevenly distributed at that surface location.

Although such systems contain non-protruding sensors that would avoid disturbing air flow laminarity along a wing surface, and logically would appear to satisfy the function of detecting ice, no such system is known to the applicant's to have been implemented in actual practice on board aircraft. One may speculate that such arrangements were found too sensitive and prone to false alarms.

An object of the present invention is to detect the presence of ice and monitor any ice build up on an aircraft's wing without disturbing laminar airflow over the wing surface.

Another object of the invention is to alert flight personnel that ice build up on an aircraft surface is excessive.

A further object of the invention is to provide a new non-invasive apparatus for measuring the thickness of a layer of semi-transparent material.

SUMMARY

In accordance with the foregoing objects, the present invention provides a compact optical measurement and alarm tool to provide a physically non-intrusive thickness probe of a light transmissive layer having particular advantage as a reliable ice detection apparatus for aircraft. The invention relies upon the principle of complete internal reflection of a light beam from the sample layer being measured and the inspection of the reflected light for determining thickness of that sample layer.

The invention includes a flat transparent quartz or glass window, having an index of refraction, less than that of the air or other gaseous environment on which the window opens. The window supports any semi-transparent material, such as ice, which may be placed or deposited on that window's surface for thickness measurement. That material, ice, as example, is of another index of refraction, less than the refractive index of the air or other gas, and less than the refractive index of the window.

Light is directed through a bundle of fiber optic strands that emits the light at a shallow angle to the window. The emitted light is incident upon the rear of the window and propagates there through into any sample layer that overlies the opposite surface of the window. At the interface between the sample layer and the air or other gas medium in the surrounding environment, the light is totally internally reflected due to the effect of the different indices of refraction. That reflection is at an equal and opposite angle to the angle of incidence.

A second bundle of fiber optic strands is oriented to receive the reflected from that window, essentially positioned at the same shallow angle, but opposite in direction. Various strands in the bundle are displaced longitudinally of said window to define at least a spatial distribution of such light receptors. A photo-multiplier or like photosensitive array device receives light transmitted through the strands in the second bundle and provides a corresponding array of outputs, each of which represents at least one of the strands in the bundle. Detection of any reflected light at any output of the photo multiplier infers the deposit or placement of semi-transparent material over the window, a result akin to that of the prior "go"-"no go" alarm devices referred to earlier. However from inspection of the spatial distribution of the photo multiplier outputs, the thickness of the overlying layer of material is determined.

The principal locale of the reflected light shifts longitudinally along the window's bottom surface and amongst the spatially distributed optical fibers associated with the receptor in dependence upon the thickness of the overlying layer. In ice detector application, as the thickness of the ice builds, the greater is such spatial shift of the reflected light. By correlating the observation of the illumination distribution pattern represented on the photo multiplier outputs, the thickness of the ice is derived. For an alarm device, when the particular degree of shift occurs that represents an excessive ice thickness, that is, attains a critical level, an alarm is given.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
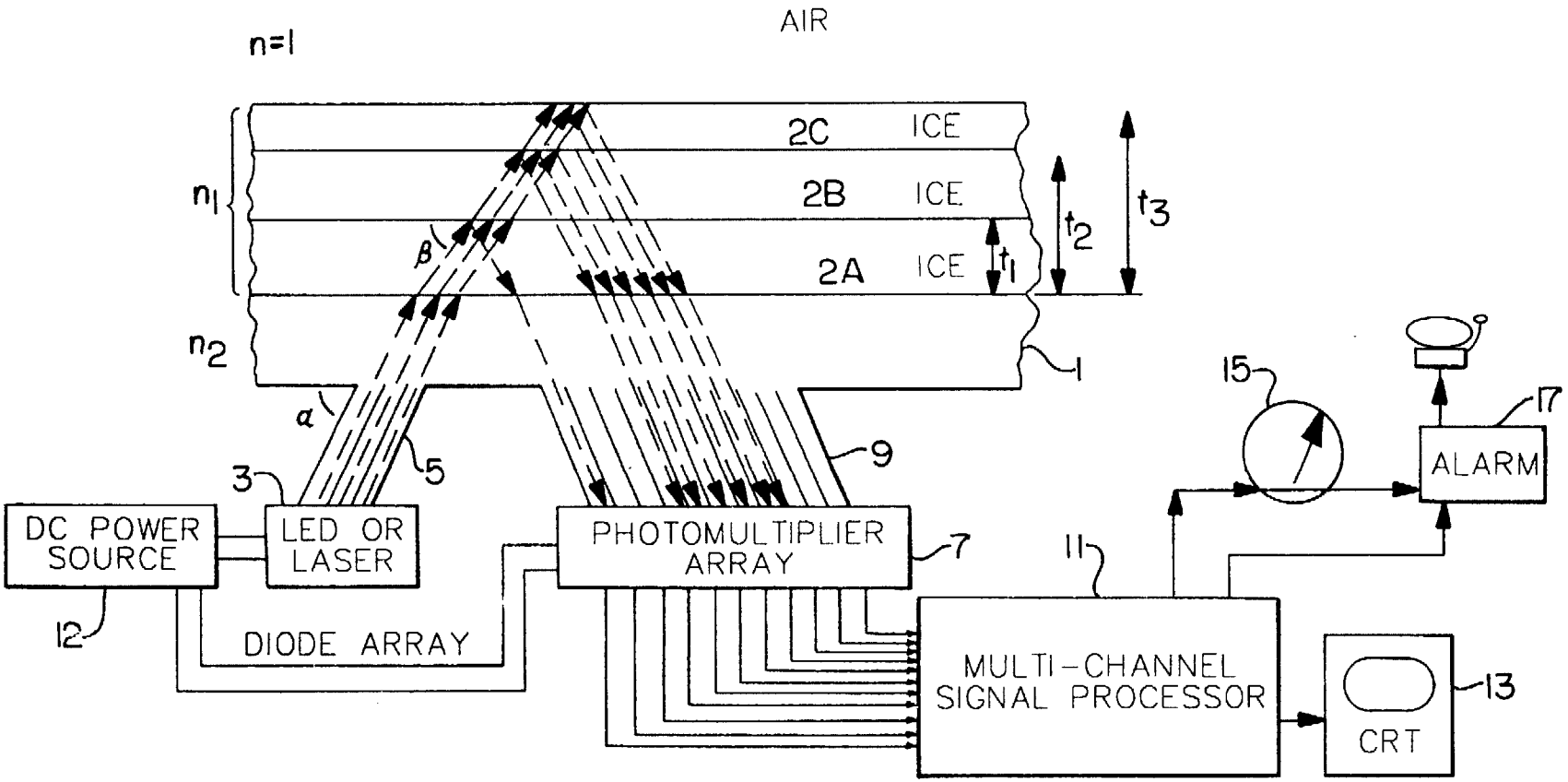
FIG. 1 is a block diagram of an embodiment of the invention illustrated in an application for monitoring the build up of a layer of ice.

Reference is made to FIG. 1, which illustrates an embodiment of the invention in block form. This includes a light transmissive detector window 1, an array of light sources 3, a bundle of fiber optic strands 5, a photo-detector array 7, a second bundle of fiber optic strands 9, a multichannel signal processor 11, and an electrical DC power source 12, that supplies power to both the light sources 3 and photo-detector array 7. The light sources in array 3 may be formed of light emitting diodes, LEDS, laser diodes or the like. Optionally, a display 13, analogue indicator 15 and/or alarm 17, coupled to processor 11, are also included in the monitoring system. The photo detector array, preferably is a semiconductor photo detector array, which uses avalanche photo diodes or a photomultiplier array. All of the foregoing elements are known component devices.

Preferably window 1 is mounted within an airfoil surface, such as an airplane wing, not illustrated, with the window's outer surface flush with the exterior of the airfoil surface. FIG. 1 also illustrates successive layers of ice 2A, 2B and 2C, which represent the accumulation or build up of ice over time on window 1 and, hence, on the airfoil surface, in which the window is mounted. It is appreciated that the ice does not form a part of the combination. That substance is illustrated in the figure as an aid in understanding the operation of the invention, later herein described.

Window 1 is a flat panel of uniform thickness and is formed of transparent fused quartz material. The light transmissive window has an index of refraction that is greater than the index of refraction of the air or any other gaseous ambient atmosphere in which the detector is disposed for operation. Although a transparent window is preferred, it will be understood from the operation of the invention that follows in this specification that windows having a semi-transparent or even translucent characteristic, which attenuates the light intensity, may be substituted, if desired.

The fiber optic strands provide a transmission medium for light energy, a light conductor, as well known. Each strand in each of the fiber optic bundles 5 and 9 contains two flat ends. One end of each strand serves as a light input and the opposite end as a light output in the foregoing combination. The input end of the strands or fibers in bundle 5 faces and is optically coupled to the light source array 3. Since light source array 7 is formed of multiple light sources, some of the strands receive light from one of the light sources in the array, and other strands receive light from other light sources in the array. The effect is that the light sources and the fiber optic strands in the bundle 5 are each spatially distributed.

At the opposite or distal end of the fibers, the axis of each fiber is oriented at a shallow angle, $\alpha$, to the rear side or face of window 1. The flat face of the fiber is oriented thus at an angle of $\alpha$+90 degrees to the window's flat rear surface. The fiber's end face is placed so that light which enters the fibers propagates to the distal end and travels from that end in a straight line to and is incident upon window 1, striking that window at a shallow angle relative to the window's flat rear surface.

Figure 4:
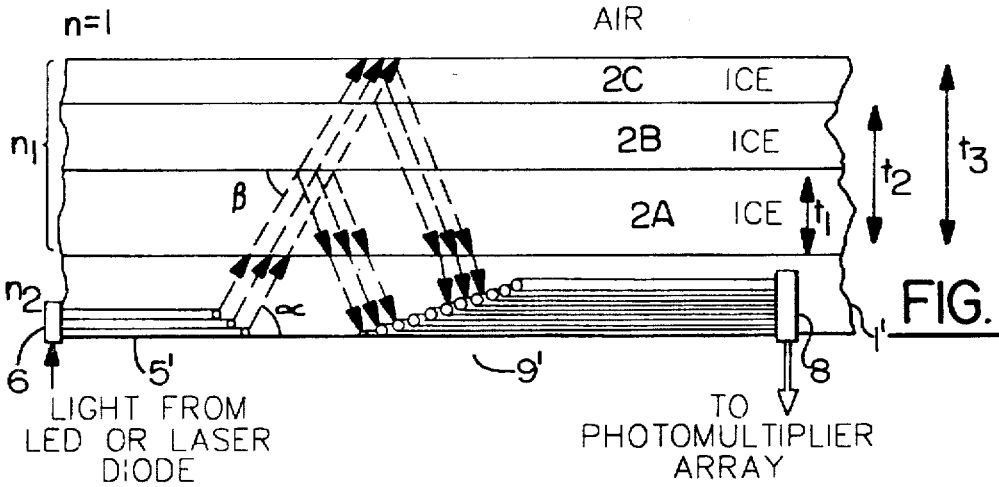
FIG. 4 is a not-to-scale partial side view of a second embodiment of the invention which employs end-capped optical fibers, illustrated in the same ice monitoring application as the embodiment of FIG. 1.
Figure 5:
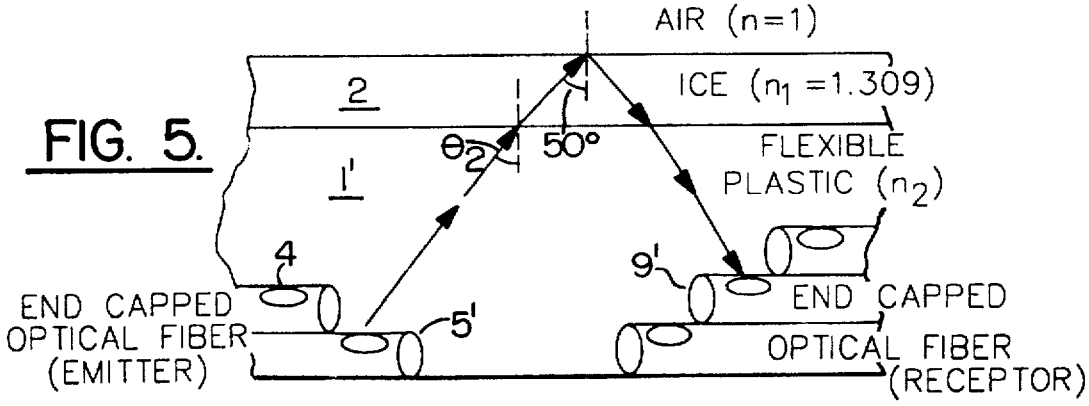
FIG. 5 is an enlarged not-to-scale pictorial view of the embodiment of FIG. 4 showing the light transmitting ends of the optical fibers in greater detail.

The distal ends of the optical fiber strands in fiber optic bundles 5 and 9 are optically coupled to the underside surface of the window by means of a standard optical connector, not illustrated. Alternatively and as illustrated in the figure, the distal end of those fiber optic bundles is preferably embedded into the rear surface of window 1 using appropriate glass fusion techniques. In the embodiment of FIGS. 4 and 5, latter herein described, a portion of the entire fiber optic bundle is embedded within a window formed of plastic material.

Semiconductor photodetector array 7 contains a plurality of photosensitive spots or pixels on its light input or photosensitive surface. When exposed to light, the electrical conductivity or state of charge of the exposed spot changes, somewhat proportionally to the intensity of the incident light. Those photosensitive positions are spatially arranged and form an array, providing a series of photosensitive spots that extend normal to the plane of the paper and, more relevant to the present invention, extend laterally, longitudinal of the axis of window 1. The photodetector array contains one output circuit for each such photosensitive spot in the array, providing a corresponding array of electrical outputs. Each such electrical output is connected to the input of the multi-channel signal processor 11.

Light sources 3 generate probe light beams which are transmitted through fiber optic bundle 5 and into the detector window 1. Those probe light beams are refracted into the ice layer 2A, 2B and 2C at an angle shallow enough to be internally reflected at the ice-air interface. The reflected light beams re-enter the detector layer by refraction. Each beam's entry into the detector fiber optic array 7 is determined by the thickness of the ice layer. The light beams transmitted into the detector fibers in bundle 9 are converted into electrical signals by photo detector 7 and are digitally processed by signal processor 11.

Figure 2:
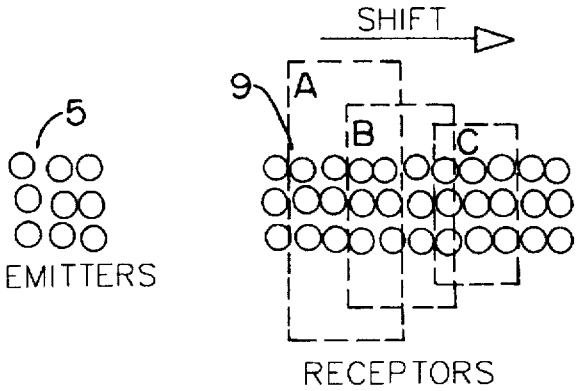
FIG. 2 is a pictorial illustration that assists in describing the operation of the embodiment of FIG. 1, illustrating the relative positioning of the ends of the fiber optic emitters and receptors and the shift of positioning in reflected light occurring with the increase in thickness of the monitored ice layer.

As the thickness of the layer increases, the pattern of reflected light moves longitudinally to the right in the figure, shifting the light in position, whereby some additional fibers on the right are exposed, and exposure of some fibers on the left decreases. This shifting is pictorially represented in FIG. 2, by the successively positioned rectangles A, B, and C, illustrated in dash lines. This spatial distribution directly correlates to the thickness of the ice or other light transmissive layer being measured.

Multi-channel signal processor 11 processes the individual signals or current from the photo detector outputs and translates that information into a detector ice thickness profile via fiber channel identification, calibration data and appropriate signal processing algorithms and displays that profile on a cathode ray tube display monitor 13. The output signal representative of the thickness level detected may be outputted to an appropriate analogue indicator, as represented by the meter symbol 15. Further, an alarm 17 may be associated with the foregoing processor 11. The alarm may be triggered when the output signal from the processor 11 attains a predetermined level, providing a visual and/or audio indication warning that the total thickness of layers 2A–2C has attained the maximum allowable level.

By placing layers of known thickness in place over the detector window 1 and examining the result at the output of signal processor 11, the signal processor can be calibrated and/or appropriate algorithms can be defined that change the form of the result to a simple thickness number, such as a digitally displayed number representing the thickness in hundredths of an inch.

From the foregoing theory of operation, it is appreciated that the quantity of strands or fibers contained in the fiber optic bundle 9, associated with the photo-multiplier 7, is determined by the maximum thickness of which the ice layer is reasonably expected to achieve.

Photosensitive charge coupled device arrays, CCD's, may be substituted for the photo detector 7. These are the photosensitive sensors commonly found in modern video cameras. The output of such a photosensor may be displayed on a television tube, showing the pattern of light emitted from fiber optic bundle 9 and providing a visual representation of the ice thickness.

Another embodiment of the invention that has the advantage of being more compact in physical size than the embodiment of FIG. 1, is partially illustrated in FIGS. 4 and 5, to which reference is made. As initial inspection of the latter figures reveals, many elements in this embodiment replace a number of the like elements presented in the embodiment of FIG. 1, differing slightly in structural detail. To assist in understanding the structure of this alternative embodiment, thus, the elements are given the same designations used to identify the corresponding elements of the embodiment of FIG. 1 and are primed.

In this embodiment, window 1' is formed of transparent flexible plastic material, which, like the window in the prior embodiment, has a higher index of refraction than air or any other gas environment in which the detector is to be placed. A portion of the fiber optic bundle assemblies 5' and 9' are embedded or, as variously termed, encased within the plastic material of the window to form a unitary integral assembly. This is easily accomplished by depositing the uncured liquid plastic onto the pre-formed fiber optic bundles and then curing or polymerizing the plastic material, allowing the plastic material to harden into the solid form. The foregoing unitary structure offers an extremely thin ribbon like assembly that advantageously may be attached to the external surface of an aircraft, such as to the airfoil surface, without adversely affecting the operation of the aircraft.

The receptor or input end of fiber optic bundle 9' is collected in a fiber optic connector 8 and the emitting or output end of fiber optic bundle 5' is collected in a fiber optic connector 6. The fiber optic connector 8 routes the same number of fibers as received from the receptor bundle to the photodetector array 7, illustrated in FIG. 1. Fiber optic connector 6 routes the same number of fibers as received from the laser diode light emitter array 3, illustrated in FIG. 1.

As illustrated to enlarged scale in simplified pictorial view of FIG. 5, the individual fibers in each bundle are end capped by a metal or light absorbing opaque layer at the circular end and is ensheathed or surface coated about its cylindrical side by a light absorbing opaque material to block entry or exit of light, except for a small optical window or opening 4 located near the fiber's end. The optical opening is positioned at the top of the fiber strand, exposed to the underside of the window's top surface, and acts as a pin hole through which light may exit, as in the emitter fibers in bundle 5', or enter, as in the receptor fibers in bundle 9'.

The opening is shaped as a lens and the axis of that lens is oriented relative to the axis of the fiber strand, which, in this embodiment, lies horizontally, so as, in the case of the emitter fiber strand, to allow light to leave the fiber strand at the desired angle $\alpha$, or, in the case of the receptor strand, enter the fiber strand only at the desired angle $\alpha$.

The staircase-like, graded stacking of the fibers achieves the required relative positioning of the emitters and receptors and the shift of positioning in reflected light occurring with the increase in thickness of the monitored layer.

The embodiment containing the plastic window depicted in FIGS. 4 and 5 is suitable for application to the outer skin surfaces of an aircraft, and avoids the necessity of making special cut-outs in the skin and mounting hardware for the ice sensor. A large number of such detectors can be installed on the aircraft skin connected by plastic ribbon strips glued on and running along the wing span, allowing the detector assembly to conform to the shape of the surface. Additionally, transparent or semi-transparent coatings may be applied to the window to provide a hard shield, protecting the window surface from erosion due to impact with abrasive particles during aircraft flight. Although such coating may cause some level of acceptable light transmission loss to the window, it should prolong the functional life of the window and, therefore, will likely be necessary to meet aerodynamic erosion protection requirements for the aircraft. Even so, the detector window should not be placed on the leading edges of the aircraft wings, because of the very high levels of erosion occuring at that location.

The basis of the foregoing operation arises from the physical properties of light referred to as Snell's law. Snell's law in physics describes the refraction occurring when light travels from one medium into another and prescribes that the mathematical sine of the angle of the light wave relative to the planar surface or interface is related to the sine of the light wave in the adjacent medium by the inverse ratio of the indices of refraction of the respective medium. When light travels from a first medium, such as glass, toward a second medium, such as air, which has a lower index of refraction than glass, total internal refraction can occur. Such light is totally refracted if the angle at which the light approaches the interface with the second medium is such that the resultant angle of refraction is, according to Snell's law, 90 degrees or less. The same physical principal holds true with several flat light transmissive mediums placed side by side and whose indices of refraction consecutively decrease. Knowing the index of refraction of each material, each critical angle may be calculated.

Fortuitously, glass possesses a higher index of refraction, 1.5, than ice, which is 1.309. This enables light entering one side of the glass window and therein refracted to be totally internally reflected at the outer surface of the ice layer where the adjacent medium is air, which has a smaller index of refraction, 1.00, than either the glass or the ice, provided that the light enters the glass at an angle less that the "critical angle" for the glass to ice interface; and in turn the light continues into the ice at an angle less than the critical angle for the ice to air interface.

Figure 3:
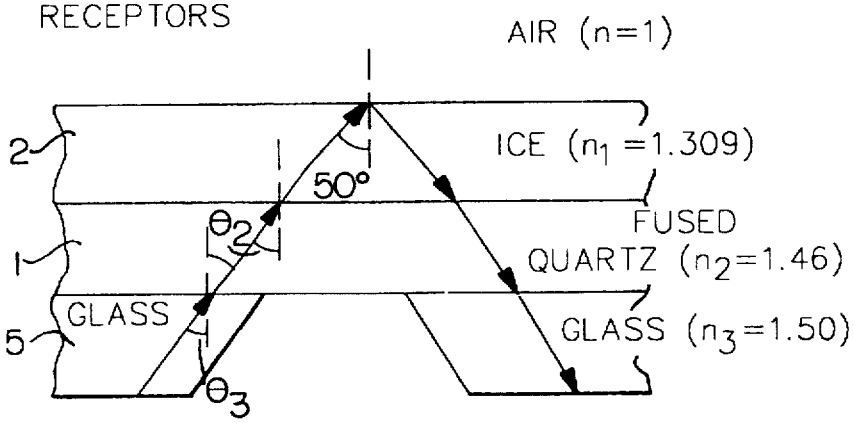
FIG. 3 is a not-to-scale partial section of a composite window for the embodiment of FIG. 1 that includes individual layers of transparent glass and fused quartz.

The material for window 1 can be selected to meet the transparency and erosion hardness requirements for aircraft application. Fused quartz 4 and sapphire, such as represented in FIG. 3, are two possible choices of material that may be formed with the glass into a composite window. The quartz and sapphire have an index of refraction that is greater than that for ice, but is similar to the index of refraction of glass, making it suitable for operation in the detector combination.

Fused quartz has an index of refraction, 1.46, which is greater than ice, but less than that of glass. Thus it is possible to insert a fused quartz layer over the glass window between the air and/or any transparent layer, such as ice, which may be placed or deposited between the air and the fused quartz layer for measurement. Using Snell's law of refraction, it may be shown that the critical angle for total internal reflection of light between an ice to air interface is 49.8 degrees; that for the quartz to ice interface is 63.7 degrees; and that for the glass to quartz interface is 76.7 degrees.

When the detector window is free of ice, most of the light reaching the air-window interface is internally reflected back to the bottom interface. That occurs because the emitter fiber incident angle $I_3$ is restricted in a range, such that the light enters the upper interface of the quartz window at an angle $I_2$, that is greater than 43.2 degrees, the critical angle the quartz-air interface. On reaching the bottom interface, the light exits the quartz into glass or, if no glass is used, the light is internally reflected back into the quartz. Should that light be reflected back into the glass it might possibly reach the receptor fibers, triggering an "ice like" signal. To prevent such a spurious internal reflection within the quartz slab from reaching the receptor fibers, the bottom surface of the quartz detector can be coated with a thin layer of light absorbing material or one having a very high index of refraction, such as an anti-reflection coating.

For aircraft application, the detector may be installed on the wings leading edges, the wing upper and/or lower surfaces, engine cowl inner and outer lip surfaces, and/or nose cowl. One ground application for aircraft is the detection of any glycol film on the aircraft surfaces.

The foregoing invention provides a two dimensional thickness profile of the ice build up on the portion of the wing surface at which the ice detector is installed. The ice build up is monitored and/or measured by the processor.

Although the foregoing embodiment employs LED's or laser diodes as the light source, other light sources may be substituted without departing from the invention. As example, infra-red or ultra-violet light sources may be used to take advantage of the spectral absorption or emission characteristics associated with an ice layer. Further, in still other embodiments, the detector window may include electrical heater elements. By heating the window the outside surface is cleaned and the temperature can be maintained at an appropriate level suitable to allow formation of a clear glaze type ice formation instead of the cloudy, rime type ice.

The novel ice detector is non-obtrusive and can be extremely compact in size. Although the invention's principal application is in the detection and thickness measurement of ice formation on an aircraft's airfoil surfaces, the invention is seen to have application in other fields in which a thickness measurement is to be made of other kinds of layers of light transmissive materials in situations where more conventional measurement devices are unavailable or impractical.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. Apparatus for monitoring the thickness of a semi-transparent material within a gaseous environment, comprising:

a detector window, having front and back sides, and being of a first predetermined thickness;

said front side of said detector window for supporting the semi-transparent material whose thickness is to be monitored;

light beam directing means for directing a plurality of individual light beams at said detector window at a first predetermined angle to said back side of said detector window;

said light beam directing means comprising a plurality of first optical fibers displaced in position relative to one another so as to be distributed longitudinally along the back side of said detector window;

light beam detector array means spaced from said light beam directing means;

said light beam detector array means comprising:

a plurality of second optical fibers for receiving light propagating at a second predetermined angle to said back side of said detector window, said second predetermined angle being opposite in direction relative to said back side of said detector window as said first predetermined angle; and said second optical fibers being displaced in position from one another relative to said back side of said detector window so as to be distributed longitudinally along said detector window; and at least a plurality of longitudinally displaced light detectors optically coupled to respective ones of said plurality of second optical fibers whereby light propagating into a second optical fiber is coupled to a corresponding one of said light detectors;

each said light detector producing an electrical output signal in dependence upon the intensity of incident light; and means for monitoring the spatial distribution of light represented by said light detectors to indicate the thickness of said semi-transparent material.

2. The apparatus as defined in claim 1, wherein said first predetermined angle is equal and opposite in direction to said second predetermined angle.

3. The apparatus as defined in claim 1, further comprising alarm means coupled to said monitoring means for providing a perceptible indication when the thickness of said semi-transparent material achieves a predetermined level.

4. The apparatus as defined in claim 1, wherein each said light detector comprises a photodetector array.

5. The apparatus as defined in claim 1, wherein said detector window comprises the material fused quartz.

6. The apparatus as defined in claim 1, wherein said detector window comprises laminate layers of glass and fused quartz.

7. The apparatus as defined in claim 1, wherein the ends of said first and second optical fibers and said window are integrally attached.

8. The apparatus as defined in claim 1 wherein said semi-transparent material is of a first index of refraction, n1, where n1 is greater than the index of refraction of said gaseous environment; and said detector window is of an index of refraction, n2, wherein n2 is greater than n1.

9. The apparatus as defined in claim 8, wherein said first predetermined angle is equal and opposite in direction to said second predetermined angle and further comprising: alarm means coupled to said monitoring means for providing a perceptible indication when the thickness of said semi-transparent material achieves a predetermined level.

10. A method of determining the thickness of a light transmissive layer of material in a gaseous medium, said light transmissive layer having a first index of refraction, n1, that is greater than the index of refraction of said gaseous medium, comprising the steps of:

placing said layer of material upon the upper surface of a light transmissive window, said light transmissive window having an index of refraction, n2, greater than n1;

concurrently directing a plurality of beams of light into said light transmissive window from a number of longitudinally distributed locations along a back surface of said window;

said beams being directed at a predetermined angle to said upper surface, $\alpha$, at which said light beams propagate through said window and said layer of material, and at which total reflection occurs at the juncture between said upper surface of said light transmissive window and said gaseous medium, whereby a plurality of beams of light are reflected back through said light transmissive window;

inspecting the spatial distribution of said reflected light beams at least along a longitudinal axis of said window, said spatial distribution being correlated to the thickness of said light transmissive layer.

11. The method as defined in claim 10, wherein said light beams comprise light of a single wavelength.

12. The method as defined in claim 10, wherein said light beam comprise light having multiple wavelengths.

13. Apparatus for monitoring the thickness of a light transmissive layer, comprising:

a detector window, said detector window being of predetermined thickness and having a front surface and a rear surface;

said front surface of said detector window for supporting said light transmissive layer, the thickness of which is to be monitored;

light beam directing means for directing a plurality of individual light beams into said detector window at a first predetermined angle, $\alpha$, to said front surface;

said light beam directing means comprising a plurality of first optical fibers, each of said first optical fibers having an output window for outputting light;

light beam detector array means spaced from said light beam directing means, said light beam detector array means comprising:

a plurality of second optical fibers extending between first and second opposed ends;

wherein a side surface of each of said second optical fibers includes an input window defining a lens for receiving light reflected from within said detector window at a second predetermined angle, $\beta$, to said front surface of said detector window; and wherein said plurality of second optical fibers are positioned such that said input windows of said plurality of second optical fibers are displaced in position from one another longitudinally relative to said detector window such that said input window of each second optical fiber is exposed to said detector window.

14. The apparatus as defined in claim 13, further comprising:

at least a plurality of longitudinally displaced light detectors, each being optically coupled to a respective one of said plurality of second optical fibers, whereby light propagating into a second optical fiber is coupled to a corresponding one of said light detectors;

each said light detector producing an electrical output signal in dependence upon the intensity of incident light; and means for monitoring the spatial distribution of light represented by said light detectors to indicate the thickness of said light transmissive layer.

15. The apparatus as defined in claim 14, further comprising alarm means coupled to said monitoring means for providing a perceptible indication when the thickness of said light transmissive layer achieves a predetermined level.

16. The apparatus as defined in claim 13, wherein said detector window comprises the material fused quartz.

17. The apparatus as defined in claim 13, wherein said detector window comprises laminate layers of glass and fused quartz.

18. The apparatus as defined in claim 13, wherein said detector window comprises plastic

19. The apparatus as defined in claim 13, wherein each of said second optical fibers of said light beam detector array means further includes:

light blocking means for preventing passage of light through said side surface and each of said first and second ends, excluding said input window defined by said side surface;

wherein said second optical fibers are stacked atop one another with said second ends thereof being consecutively horizontally staggered in position to expose each of said input windows and form a staircase like end configuration; wherein a second end of an uppermost one of said second optical fibers is horizontally positioned spaced from the horizontal position of a corresponding second end of an underlying one of said second optical fibers to expose said input window of said underlying one of said second optical fibers.

20. Apparatus for monitoring the thickness of a light transmissive layer, comprising:

a detector window, said detector window being of predetermined thickness and having a front surface and a rear surface;

said front surface of said detector window for supporting said light transmissive layer, the thickness of which is to be monitored;

light beam directing means for directing a plurality of individual light beams into said detector window at a first predetermined angle, $\alpha$, to said front surface, said light beam directing means comprising a plurality of first optical fibers extending between a first end and a second end; wherein a side surface of each first optical fiber light beam detector array means spaced from said light beam directing means, said light beam detector array means comprising a plurality of second optical fibers for receiving light reflected from within said detector window at a second predetermined angle, $\beta$, to said front surface of said detector window.

21. The apparatus as defined in claim 20, wherein said detector window comprises the material plastic; and wherein said plurality of first and second optical fibers are at least partially encased within said detector window.

22. The apparatus as defined in claim 21, further comprising:

first optical connector means attached to said first end of said plurality of first optical fibers and second optical connector means connected to a first end of said plurality of second optical fibers.

* * * * *

UNITED STATES PATENT AND TRADEMARK OFFICE

CERTIFICATE OF CORRECTION

PATENT NO. : 5,748,091

DATED : May 5, 1998

INVENTOR(S) : Kim

It is certified that error appears in the above-identified patent and that said Letters Patent is hereby corrected as shown below:

Column 9, line 8, "beam" should be --beams--.

Column 10, line 7, after "plastic" insert a period (.).

Column 10, line 14, after "surface;" insert --and--.

Column 10, line 40, after "fiber" insert -- includes an output window defining a lens for optical transmission of light at first predetermined angle, said first redetermined angle being less than ninety degrees; and wherein each said first optical fiber is oriented with said output window exposed to said front surface of said detection window; and --.

Column 10, line 40, begin new sub-paragraph with "light beam".

Signed and Sealed this

Fourteenth Day of July, 1998

Bruce Lehman

*Attest:*

BRUCE LEHMAN

*Attesting Officer*

*Commissioner of Patents and Trademarks*